US012692658B2

(12) United States Patent
Nagai et al.

(10) Patent No.: US 12,692,658 B2
(45) Date of Patent: Jul. 28, 2026

(54) METHOD OF CONTROLLING SHEET MANUFACTURING APPARATUS

(71) Applicant: SEIKO EPSON CORPORATION, Tokyo (JP)

(72) Inventors: Yoshikazu Nagai, Matsumoto (JP); Akira Hashimoto, Shiojiri (JP); Tetsuya Tamura, Matsumoto (JP); Naoto Aruga, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 121 days.

(21) Appl. No.: 18/900,998

(22) Filed: Sep. 30, 2024

(65) Prior Publication Data

US 2025/0109553 A1 Apr. 3, 2025

(30) Foreign Application Priority Data

Oct. 2, 2023 (JP) ..... 2023-171149

(51) Int. Cl.
*D21H 25/04* (2006.01)
*D21G 9/00* (2006.01)

(52) U.S. Cl.
CPC ..... *D21G 9/0036* (2013.01); *D21H 25/04* (2013.01)

(58) Field of Classification Search
CPC ..... D21H 25/04; D21G 9/0036
USPC ..... 162/525
See application file for complete search history.

(56) References Cited

U.S. PATENT DOCUMENTS

2007/0219080 A1* 9/2007 Otomo ..... B65H 9/06 493/405
2012/0138625 A1* 6/2012 Case ..... B65H 31/3009 221/34
2014/0260087 A1* 9/2014 Antoniazzi ..... B65B 25/146 53/204
2014/0290886 A1 10/2014 Nagai et al.
2017/0182723 A1* 6/2017 Calisch ..... F21V 1/18
2020/0223655 A1* 7/2020 Komada ..... B65H 37/06

FOREIGN PATENT DOCUMENTS

JP 2014-208923 A 11/2014

* cited by examiner

*Primary Examiner* — Jacob T Minskey
(74) *Attorney, Agent, or Firm* — Spencer Fane LLP

(57) ABSTRACT

A method of controlling a sheet manufacturing apparatus is applied to a sheet manufacturing apparatus including a defibrating portion, an accumulating portion that forms web, a second transporting portion that includes a transporting belt to transport the web, and a pressing portion that includes a pair of pressing rollers formed from a first roller and a second roller and forms a strip-shaped sheet by pressing the web. The method includes a first step of transporting the web with the transporting belt, a second step of peeling a tip end of the web off the transporting belt, a third step of bending the tip end of the web by rotating the first roller in a first direction, and a fourth step of folding the tip end of the web by rotating the first roller in a second direction and passing the web between the pair of pressing rollers.

3 Claims, 4 Drawing Sheets

METHOD OF CONTROLLING SHEET MANUFACTURING APPARATUS

The present application is based on, and claims priority from JP Application Serial Number 2023-171149, filed Oct. 2, 2023, the disclosure of which is hereby incorporated by reference herein in its entirety.

BACKGROUND

1. Technical Field

The present disclosure relates to a method of controlling a sheet manufacturing apparatus.

2. Related Art

There have heretofore been known apparatuses for manufacturing sheets by using fibers obtained by defibrating used paper and the like in air. Such apparatuses include one configured to shape a sheet from web containing fibers. For example, JP-A-2014-208923 discloses a sheet manufacturing apparatus that includes a pressing roller and a heating roller in order to shape web into a sheet.

However, the apparatus disclosed in JP-A-2014-208923 may cause a problem of the apparatus in a case where a tip end of the web has a small thickness. Specifically, there is a problem of a difficulty in controlling the thickness at the tip end of the web in a process of forming the web by accumulating a material such as fibers in the air. If the thickness of the tip end of the web becomes small, the web may occasionally adhere to a heating roller. Meanwhile, since a thickness of a tip end of a sheet shaped from the web is also reduced, the sheet is prone to buckling due to a shortage in mechanical strength at the tip end thereof. In other words, the tip end of the sheet may be caught on a component such as a transportation roller in a transportation path for the sheets and may possibly cause a paper jam. The following method has been accomplished in order to solve the aforementioned problems.

SUMMARY

A method of controlling a sheet manufacturing apparatus is a method of controlling a sheet manufacturing apparatus configured to manufacture a sheet from a material containing a fiber, the sheet manufacturing apparatus being provided with a defibrating portion that defibrates the material containing the fiber and generates a defibrated material, an accumulating portion that forms web by accumulating the defibrated material, a web transporting portion that includes a transporting belt to come into contact with one surface of the web and to transport the web, and a pressing portion that includes a pair of pressing rollers formed from a first roller and a second roller, and forms the sheet by pressing the web, the method of controlling a sheet manufacturing apparatus including: a first step of transporting the web with the transporting belt; a second step of peeling a tip end of the web off the transporting belt; a third step of bending the tip end of the web by rotating the first roller in a first direction; and a fourth step of folding the tip end of the web by rotating the first roller in a second direction being opposite to the first direction and passing the web between the pair of pressing rollers.

DESCRIPTION OF EMBODIMENTS

The following embodiment exemplifies a sheet manufacturing apparatus 1 of a dry type as a sheet manufacturing apparatus that manufactures sheets from a material containing fibers, which recycles slips of paper such as used paper into the sheets. Now, the sheet manufacturing apparatus 1 and a controlling method thereof will be described below with reference to the drawings.

Note that the sheet manufacturing apparatus of the present disclosure is not limited to be of the dry type but may also be of a wet type. In the present disclosure, the dry type is a mode implemented in air such as atmosphere without being implemented in a liquid.

In the respective drawings cited below, xyz axes are provided as coordinate axes that are orthogonal to one another. A direction indicated with each arrow will be defined as + direction while a direction opposite to the + direction will be defined as − direction. The z axis is a virtual axis extending along a vertical direction. Here, +z direction is deemed to be upward while −z direction is deemed to be downward. The −z direction is equivalent to a direction of action of the gravity. Meanwhile, in the sheet manufacturing apparatus 1, a destination in a direction of transportation of raw materials, web, sheets, and the like may be referred to downstream while the other side to head back in the direction of transportation may be referred to upstream in some cases. Sizes of respective constituents may be different from actuality for the convenience of illustration.

1. Sheet Manufacturing Apparatus

Figure 1:
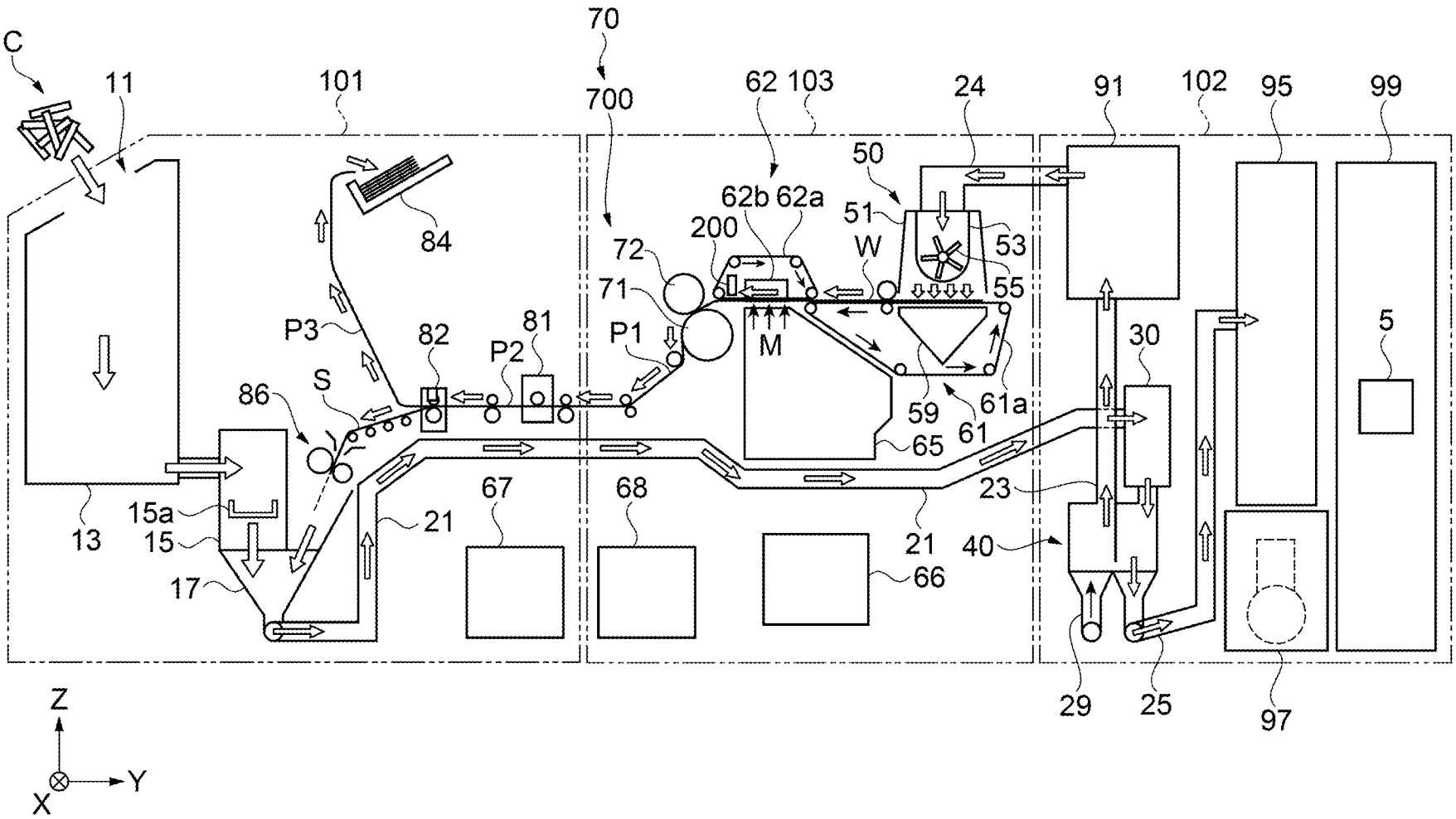
FIG. 1 is a schematic diagram illustrating a configuration of a sheet manufacturing apparatus according to an embodiment.

As illustrated in FIG. 1, the sheet manufacturing apparatus 1 according to the present embodiment includes a first unit group 101, a second unit group 102, and a third unit group 103. The first unit group 101, the second unit group 102, and the third unit group 103 are supported by a not-illustrated frame. In FIG. 1, directions of movement of used paper C, sheets P3, slit pieces S, unnecessary listing, and the like are indicated with open arrows.

The sheet manufacturing apparatus 1 manufactures the sheet P3 from the used paper C being a material that contains fibers. In the sheet manufacturing apparatus 1, the first unit group 101, the third unit group 103, and the second unit group 102 are arranged from the −y direction to the +y direction in side view from the −x direction.

The used paper C is transported from the first unit group 101 to the second unit group 102 through a pipe 21 that traverses the inside of the third unit group 103. Then, the used paper C undergoes defibration and the like in the second unit group 102 so as to be converted into fibers, which are then formed into a mixture that contains a binding agent and the like. The mixture is transported to the third unit group 103 through a pipe 24. The mixture is formed into web W by the third unit group 103 and then shaped into a strip-shaped sheet P1. The strip-shaped sheet P1 is cut into the sheets P3 in the first unit group 101.

The first unit group 101 includes a buffer tank 13, a volumetric feeder portion 15, a confluent portion 17, and the pipe 21. In the first unit group 101, these constituents are arranged in the enumerated order from the upstream to the downstream. Moreover, the first unit group 101 also includes a first cutting portion 81, a second cutting portion 82, a tray 84, and a shredding portion 86. The first cutting portion 81 and the second cutting portion 82 cut the strip-shaped sheet P1 into the sheets P3 in a predetermined shape. Furthermore, the first unit group 101 includes a water feeding portion 67. The water feeding portion 67 is a water storage tank. The water feeding portion 67 feeds water for humidification to each of a first humidifying portion 65 and a second humidifying portion 66 to be described later by using not-illustrated water feed pipes.

The used paper C is put from a raw material input slot 11 into the buffer tank 13. The used paper C is a scrap of shredded used paper that contains fibers such as cellulose, for example. Humidified air is supplied from the second humidifying portion 66 provided to the third unit group 103 into the buffer tank 13.

The used paper C to be defibrated is temporarily stored in the buffer tank 13 and is then transported to the volumetric feeder portion 15 in accordance with an operation of the sheet manufacturing apparatus 1. The sheet manufacturing apparatus 1 may include a shredder located upstream of the buffer tank 13 and configured to shred the used paper C and the like.

The volumetric feeder portion 15 includes a measure 15*a* and a not-illustrated feeding mechanism. The measure 15*a* measures the mass of the used paper C. The feeding mechanism feeds the used paper C measured with the measure 15*a* to the confluent portion 17 located downstream. In other words, the volumetric feeder portion 15 measures the used paper C into each predetermined mass with the measure 15*a* and feeds the measured used paper C to the confluent portion 17 located downstream by using the feeding mechanism.

The measure 15*a* can adopt a measuring mechanism of a digital type or an analog type. To be more precise, the measure 15*a* may adopt a physical sensor such as a load cell, a spring scale, a balance, and the like. In the present embodiment, a load cell is used as the measure 15*a*. The predetermined mass of the used paper C to be measured with the measure 15*a* ranges from about several grams to several tens of grams, for example.

The feeding mechanism can adopt publicly known techniques such as a vibration feeder. The feeding mechanism may be incorporated in the measure 15*a*.

The measurement and feeding operations of the used paper C by the volumetric feeder portion 15 are batch processes. In other words, the feeding of the used paper C from the volumetric feeder portion 15 to the confluent portion 17 is intermittently carried out. The volumetric feeder portion 15 may include two or more measures 15*a*, and may improve measurement efficiency by operating the measures 15*a* in a time-shifted fashion.

In the confluent portion 17, the shredded slit pieces S supplied from the shredding portion 86 is put into and mixed with the used paper C fed from the volumetric feeder portion 15. The slit pieces S and the shredding portion 86 will be described later. The used paper C mixed with the above-mentioned shredded pieces flows from the confluent portion 17 into the pipe 21.

The pipe 21 transports the used paper C from the first unit group 101 to the second unit group 102 by using an airflow generated by a not-illustrated blower.

The second unit group 102 includes a defibrating portion 30 being a dry-type defibrator, a separating portion 40, a pipe 23, a mixing portion 91, and the pipe 24. In the second unit group 102, these constituents are arranged in the enumerated order from the upstream to the downstream. Moreover, the second unit group 102 also includes a collecting portion 95, a compressor 97, a power source portion 99, a pipe 25 that is connected to the separating portion 40, and an airflow pipe 29.

The used paper C transported in the pipe 21 flows into the defibrating portion 30. The defibrating portion 30 defibrates the used paper C being a material containing the fibers in a dry mode, thus generating a defibrated material containing the fibers. A publicly known defibration mechanism is applicable to the defibrating portion 30. In the present embodiment, a defibration mechanism provided with rotary blades is used as the defibrating portion 30. The defibration mechanism is configured to generate the fibers by shredding and defibrating the used paper C with the rotary blades.

The used paper C is formed into the defibrated material containing the fibers by disentangling the entangled fibers contained in the used paper C by using the defibrating portion 30, and the defibrated material is transported to the separating portion 40.

The separating portion 40 separates the defibrated fibers. Specifically, the separating portion 40 removes certain components contained in the fibers, which are unnecessary for manufacturing the sheets P3. That is to say, the separating portion 40 separates relatively long fibers from relatively short fibers. The relatively short fibers may cause a degradation in strength of the sheets P3, and are therefore sifted and eliminated by the separating portion 40. Moreover, the separating portion 40 also eliminates impurities such as coloring materials and additives contained in the used paper C.

A publicly known separation mechanism is applicable to the separating portion 40. In the present embodiment, a disk-type separation mechanism provided with a separation filter is used as the separating portion 40. The separation mechanism is configured to sift and separate the relatively short fibers that pass through the separation filter from the relatively long fibers that do not pass through the separation filter. The relatively long fibers are used as the defibrated fibers, which is the material of the web W.

The humidified air is supplied from the second humidifying portion 66 of the third unit group 103 into the separating portion 40.

The defibrated fibers are deprived of the relatively short fibers and the like by the separating portion 40. Then, the defibrated fibers are transported with an airflow, which is generated by a not-illustrated blower disposed at a tip end of the airflow pipe 29, to the mixing portion 91 through the pipe 23. Unwanted substances such as the relatively short fibers and the impurities are discharged to the collecting portion 95 through the pipe 25. The mixing portion 91 mixes the fiber with the binding agent and the like in the air, thereby forming the mixture. Although illustration is omitted, the mixing portion 91 includes a flow path to transport the fiber, a fan, a hopper, a supply pipe, and a valve.

The hopper communicates with the flow path for the fiber through the supply pipe. The valve is provided to the supply valve located between the hopper and the flow path. The hopper supplies the binding agent such as starch into the flow path. The valve adjusts a mass of the binding agent to be supplied from the hopper to the flow path. In this way, a mixture ratio of the fibers and the binding agent is adjusted.

In addition to the aforementioned structure for supplying the binding agent, the mixing portion 91 may include similar structured for supplying coloring agents, additives, and the like.

The fan in the mixing portion 91 generates an airflow so as to transport the fibers to the downstream and to mix the defibrated material with the binding agent and the like in the air at the same time, thus forming the mixture. The mixture flows from the mixing portion 91 into the pipe 24.

The collecting portion 95 includes a not-illustrated filter. The filter is configured to filter the unwanted substances such as the relatively short fibers transported in the pipe 25 by the airflow.

The compressor 97 generates compressed air. The above-mentioned filter may cause clogging of fine particles and the like among the unwanted substances. The compressed air generated by the compressor 97 is caused to blow against the filter, so that the compressed air can blow the adhering particles away and clean the filter.

The power source portion 99 includes a not-illustrated power supply device that supplies electric power to the sheet manufacturing apparatus 1, and a control unit 5. The power source portion 99 distributes the electric power supplied from outside to the respective structures in the sheet manufacturing apparatus 1.

Although illustration is omitted, the control unit 5 includes a central processing unit (CPU), and a storage unit that contains a random access memory (RAM), a read only memory (ROM), and so forth. Various programs for controlling the sheet manufacturing apparatus 1 are stored in the storage unit. The control unit 5 may include dedicated hardware (an application specific integrated circuit: ASIC) for executing at least part of various processing. Specifically, the control unit 5 may be constructed as a circuit that includes one or more processors to be operated in accordance with computer programs (software), one or more dedicated hardware circuits such as the ASIC, or a combination of these constituents.

The processor includes the CPU, and a memory such as the RAM and the ROM. The memory stores program codes or instructions configured to cause the CPU to execute the processing. The memory, namely, a computer-readable medium includes any media accessible to a general-purpose or special-purpose computer.

The control unit 5 is electrically coupled to respective structures in the sheet manufacturing apparatus 1 including a second transporting portion 62, an air injecting portion 200, and a pressing portion 70, and integrally controls operations of these structures. In particular, the control unit 5 also governs control related to folding of the web W to be described later.

The third unit group 103 accumulates and compresses the mixture containing the fibers, thereby shaping the mixture into the strip-shaped sheet P1 which is recycled paper. The third unit group 103 includes an accumulating portion 50, a first transporting portion 61, the second transporting portion 62, the first humidifying portion 65, the air injecting portion 200, the second humidifying portion 66, a draining portion 68, and the pressing portion 70. Note that the second transporting portion 62 is an example of a web transporting portion of the present disclosure.

In the third unit group 103, the accumulating portion 50, the first transporting portion 61, the second transporting portion 62, the first humidifying portion 65, and the pressing portion 70 are arranged in the enumerated order from the upstream to the downstream. The air injecting portion 200 is located inside the second transporting portion 62 and is disposed at a downstream end portion of a transportation path for the web W in the second transporting portion 62. The second humidifying portion 66 is disposed below the first humidifying portion 65.

The accumulating portion 50 forms the web W by accumulating the mixture generated from the defibrated material while using an air flow and a gravitational force. The accumulating portion 50 includes a drum member 53, a vane member 55 installed in the drum member 53, a housing 51 to house the drum member 53, and a suctioning portion 59. The mixture is taken from the pipe 24 into the drum member 53.

The first transporting portion 61 is disposed below the accumulating portion 50. The first transporting portion 61 includes a mesh belt 61*a* and five non-illustrated stretch rollers for stretching the mesh belt 61*a*. The suctioning portion 59 is opposed to the drum member 53 in the direction along the z axis while interposing the mesh belt 61*a* therebetween.

The vane member 55 is located inside the drum member 53 and is rotationally driven by a not-illustrated motor. The drum member 53 is a sieve having a shape of a semicircular column. A mesh having a sieve function is provided on a side surface of the drum member 53 which is directed downward. The drum member 53 causes particles of the fibers and the mixture smaller than a size of mesh openings of the sieve to pass through the mesh from inside to outside.

The mixture is agitated by the rotating vane member 55 inside the drum member 53 and is discharged to outside of the drum member 53. The humidified air is supplied from the second humidifying portion 66 into the drum member 53. The suctioning portion 59 is disposed below the drum member 53. The suctioning portion 59 suctions the air inside the housing 51 through pores provided to the mesh belt 61*a*. Thus, an airflow that accumulates the mixture on the mesh belt 61*a* is generated. The pores in the mesh belt 61*a* cause the air to pass therethrough but hardly causes the fibers, the binding agent, and the like included in the mixture to pass therethrough. Accordingly, the mixture discharged to the outside of the drum member 53 is suctioned downward together with the air. The suctioning portion 59 is a publicly known suctioning device such as a suctioning fan.

The mixture is dispersed in the air inside the housing 51 and is accumulated on an upper surface of the mesh belt 61*a* by the gravitational force and the airflow generated by the suctioning portion 59. Hence, the mixture turns into the web W.

The mesh belt 61*a* is an endless belt that is stretched around the five stretch rollers. The mesh belt 61*a* is rotated counterclockwise in FIG. 1 by rotation of the stretch rollers. In this way, the mixture is continuously accumulated on the mesh belt 61*a* and the web W is thus formed. The web W contains relatively a lot of air and is softly puffed. The first transporting portion 61 transports the generated web W downstream by the rotation of the mesh belt 61*a*.

The second transporting portion 62 transports the web W at the downstream of the first transporting portion 61 and instead of the first transporting portion 61. The second transporting portion 62 peels the web W off the upper surface of the mesh belt 61*a*, and transports the web W toward the pressing portion 70. The second transporting portion 62 is located above the transportation path for the web W and is disposed slightly on an upstream side relative to a point of origin on a return side of the mesh belt 61*a*. A portion in the +y direction of the second transporting portion 62 partially overlaps a portion in the −y direction of the mesh belt 61*a* in terms of the vertical direction.

The second transporting portion 62 includes a transporting belt 62*a*, four non-illustrated stretch rollers, and a suctioning portion 62*b*. The transporting belt 62*a* is provided with pores that allows the air to pass therethrough. The transporting belt 62*a* is stretched around the four stretch rollers and is rotated clockwise in FIG. 1 by rotation of the stretch rollers.

The suctioning portion 62*b* is located on the transportation path for the web W by the second transporting portion 62 and is disposed above the transporting belt 62*a*. The suctioning portion 62*b* suctions the air located below upward through the pores provided to the transporting belt 62*a*. Thus, one surface being an upper surface of the web W is suctioned toward a lower surface of the transporting belt 62*a*. By rotating the transporting belt 62*a* in this state, the web W is suctioned to the transporting belt 62*a* and transported downstream. In other words, the transporting belt 62*a* comes into contact with the one surface of the web W and transports the web W. The suctioning portion 62*b* is a publicly known suctioning device such as a suctioning fan.

The first humidifying portion 65 humidifies the web W containing the fibers accumulated by the accumulating portion 50 of the third unit group 103. Specifically, the first humidifying portion 65 is a mist-type humidifier configured to supply mist M from below to the web W transported by the second transporting portion 62, thereby humidifying the web W. The first humidifying portion 65 is disposed below the second transporting portion 62 and is opposed to the web W, which is transported by the second transporting portion 62, in the direction along the z axis. A publicly known humidification device such as an ultrasonic humidifier is applicable to the first humidifying portion 65.

Humidification of the web W with the mist M facilitates a function of the binding agent included in the web W, thereby increasing the strength of the sheets P3. Meanwhile, since the web W is humidified from below, drips originating from the mist M are kept from dropping on the web W. Moreover, since the web W is humidified from an opposite side of the one surface of the web W that is in contact with the transporting belt 62*a*, adhesion of the web W to the transporting belt 62*a* is reduced. The second transporting portion 62 transports the web W toward the pressing portion 70.

The air injecting portion 200 is located in the second transporting portion 62 and disposed downstream of the suctioning portion 62*b*. Although illustration is omitted, the air injecting portion 200 includes a pressurized air tank and an injection nozzle. The pressurized air tank supplies pressurized air to the injection nozzle. The air injecting portion 200 injects the pressurized air downward from the injection nozzle to the web W. The pressurized air is supplied from a not-illustrated compressor for the air injecting portion 200 and is stored in the pressurized air tank, for example.

The injection nozzle is an elongate opening that extends in a direction along the x axis. The injection nozzle is opposed to the web W transported by the transporting belt 62*a* in a direction along the z axis. The pressurized air injected from the air injecting portion 200 passes through the transporting belt 62*a* and hits the one surface of the web W suctioned to the lower surface of the transporting belt 62*a*. In this instance, a length of the injection nozzle is larger than a length of the web W in terms of the direction along the x axis. Accordingly, the pressurized air injected from the injection nozzle is sprayed on the entire width region of the web W.

In this way, the web W is peeled off the transporting belt 62*a*. The injection of the pressurized air by the air injecting portion 200 is carried out when a tip end on the downstream side of the web W reaches a region opposed to the air injecting portion 200. Then, after the aforementioned tip end of the web W is peeled off the transporting belt 62*a*, an operation to bend the tip end of the web W and an operation to fold the tip end of the web W are carried out. Thereafter, the web W is delivered from the second transporting portion 62 to the pressing portion 70. Details of the bending and the folding operations of the web W will be described later.

The pressing portion 70 includes a pair of pressing rollers 700 formed from a first roller 71 and a second roller 72. The pressing portion 70 passes the web W between the pair of pressing rollers 700, thereby forming the strip-shaped sheet P1 from the web W.

The first roller 71 and the second roller 72 form the pair and each of the rollers is a member having a substantially columnar shape. A rotating shaft of the first roller 71 and a rotating shaft of the second roller 72 are arranged along the x axis. With respect to the transportation path for the web W, the first roller 71 is disposed almost below while the second roller 72 is disposed almost above. The first roller 71 and the second roller 72 are rotated while coming close to each other during formation of the strip-shaped sheet P1 from the web W.

In the direction along the x axis, a length of the first roller 71 and a length of the second roller 72 are larger than the length of the web W, or in other words, the width of the web W. Accordingly, the web W is securely caught between the first roller 71 and the second roller 72.

A diameter of the first roller 71 is larger than a diameter of the second roller 72. For example, the diameter of the first roller 71 is equal to or above 110 mm and equal to or below 150 mm, and the diameter of the second roller 72 is equal to or above 80 mm and equal to or below 110 mm.

The first roller 71 includes a cored bar and a superficial layer that covers the cored bar, for example. A hollow structure formed from aluminum, iron, stainless steel, and the like can be cited as an example of the cored bar. A fluorine-containing resin such as polytetrafluoroethylene (PTFE), tetrafluoroethylene-perfluoroalkyl vinyl ether copolymer (PFA), tetrafluoroethylene-hexafluoropropylene copolymer (FEP), and tetrafluoroethylene-ethylene copolymer (ETFE), silicone resin, and the like can be cited as an example of a material of the superficial layer. In this way, releasability of the first roller 71 with respect to the web W is improved. In the meantime, this configuration suppresses wear and damage of the cored bar.

The second roller 72 includes a cored bar, an intermediate layer, and a superficial layer, for example. A hollow structure formed from aluminum, iron, stainless steel, and the like can be cited as an example of the cored bar. The intermediate layer covers the cored bar and is covered by the superficial layer. In other words, the intermediate layer is interposed between the cored bar and the superficial layer.

An elastic body such as silicone rubber and urethane rubber can be cited as an example of a material of the intermediate layer. Hardness of the aforementioned elastic body is preferably equal to or above 30 and equal to or below 70, or more preferably equal to or above 40 and equal to or below 60 in terms of a measurement value with an Asker C hardness scale. A thickness of the intermediate layer is preferably equal to or above 1 mm and equal to or below 10 mm, or more preferably equal to or above 1 mm and equal to or below 5 mm.

A fluorine-containing resin such as polytetrafluoroethylene (PTFE), tetrafluoroethylene-perfluoroalkyl vinyl ether copolymer (PFA), tetrafluoroethylene-hexafluoropropylene copolymer (FEP), and tetrafluoroethylene-ethylene copolymer (ETFE) can be cited as an example of a material of the superficial layer.

When the second roller 72 adopts the above-described configuration, releasability of the second roller 72 with respect to the web W is improved. In the meantime, this configuration suppresses wear and damage of the intermediate layer.

The web W is pressed in the course of passage between the first roller 71 and the second roller 72. A pressure from the first roller 71 and the second roller 72 to the web W is preferably equal to or above 0.1 MPa and equal to or below 15.0 MPa, more preferably equal to or above 0.2 MPa and equal to or below 10.0 MPa, or even more preferably equal to or above 0.4 MPa and equal to or below 8.0 MPa. Thus, deterioration of the fibers in the web W is suppressed.

The first roller 71 has an electric heater built-in and has a function to increase the temperature on a surface of the roller. It is preferable to provide the second roller 72 with a function to increase the temperature on a surface of the roller with an electric heater as with the first roller 71.

A surface temperature of the first roller 71, that is to say, a temperature of the superficial layer of the first roller 71 that comes into contact with the web W is preferably set equal to or above 100° C. and equal to or below 130° C. A surface temperature of the second roller 72, that is to say, a temperature of the superficial layer of the second roller 72 that comes into contact with the web W is preferably set equal to or above 80° C. and equal to or below 100° C.

The surface of the first roller 71 has fine asperities. The asperities on the surface adopt surface roughness measured with a surface roughness meter as an indicator. The surface roughness of the surface of the first roller 71 is preferably equal to or above 2 μm and equal to or below 8 μm, or more preferably equal to or above 3 μm and equal to or below 6 μm in terms of arithmetic average roughness (Ra). On the other hand, the surface roughness is preferably equal to or above 15 μm and equal to or below 70 μm, or more preferably equal to or above 25 μm and equal to or below 50 μm in terms of the maximum height (Rz). The asperities on the surface of the first roller 71 may originate from a surface of the core bar or may originate from a surface of the superficial layer. These asperities are formed by blasting or thermal spraying, for example.

The second roller 72 includes the elastic intermediate layer as described above. Accordingly, when the web W is shaped by pinching the web W between the first roller 71 and the second roller 72, the asperities are apt to develop on the surface of the strip-shaped sheet P1 which comes into contact with the second roller 72. On the other hand, if the surface of the first roller 71 is made flat and smooth, the surface of the strip-shaped sheet P1 that comes into contact with the first roller 71 is apt to be flat and smooth. In this case, top and bottom surfaces of the strip-shaped sheet P1 are prone to bring about a difference in surface quality. This difference in surface quality may bring about a difference in smoothness between top and bottom surfaces of the sheet P3, and the top and bottom surfaces of the sheet P3 may need to be distinguished from each other when the sheet P3 is used as copy paper and the like.

On the other hand, the above-mentioned fine asperities on the surface of the first roller 71 reduces the difference in surface quality between the top and bottom surfaces of the strip-shaped sheet P1, so that the sheet P3 can be used without distinguishing between the top and bottom surfaces thereof. Moreover, followability of the web W with respect to the first roller 71 is improved in the course of bending the web W to be described later, so that the web W can be bent easily.

The first roller 71 is rotationally driven by a stepping motor unillustrated. The second roller 72 is a driven roller which is not driven by a motor but works in conjunction with the rotation of the first roller 71. Accordingly, the second roller 72 is rotated in a direction opposite to that of the first roller 71 in side view from the −x direction.

The web W is heated and pressed while being pinched between the first roller 71 and the second roller 72, and is sent downstream. In other words, the web W is continuously passed through the pressing portion 70, thereby being heated and press-formed. The web W is heated and pressed efficiently by using the first roller 71 and the second roller 72 as a pair of shaping members.

Having passed through the pressing portion 70, the web W is changed from a soft state of containing relatively a lot of air to a state of an increased density with reduction of the air contained therein. Then, the fibers are bonded to one another with the bonding agent and the web W is shaped into the strip-shaped sheet P1. The strip-shaped sheet P1 is transported to the first unit group 101 by using not-illustrated rollers.

Here, the web W is formed by accumulating the mixture. Accordingly, the thickness of the web W is unstable in an initial stage of forming the web W, or in other words, in a region at the tip end of the web W. In general, the thickness at the tip end of the web W tends to be smaller than a thickness of a subsequent portion. If the aforementioned thickness is small, there is a possibility of incurring a problem such as adhesion to the first roller 71 or the second roller 72 and clogging of the strip-shaped sheet P1 in a path. On the other hand, in the sheet manufacturing apparatus 1, the occurrence of the above-mentioned problem is prevented by doubling the tip end and increasing the thickness thereof in accordance with a controlling method to be described later. In the following description, a tip end on the downstream side in the direction of transportation of the web W may be simply referred to as the tip end of the web W in some cases.

The second humidifying portion 66 is disposed below the first humidifying portion 65. A publicly known evaporative humidification device is applicable to the second humidifying portion 66.

The second humidifying portion 66 humidifies a predetermined region of the sheet manufacturing apparatus 1. The predetermined region includes one or more of the buffer tank 13, the separating portion 40, and the drum member 53 of the accumulating portion 50. To be more precise, the humidified air is supplied from the second humidifying portion 66 to the above-mentioned region by the intermediary of not-illustrated pipes. The humidified air suppresses electrostatic charge of the used paper C, the fibers, and the like in the respective constituents mentioned above, thus curbing adhesion of these substances to the aforementioned members due to the static electricity.

The draining portion 68 is a drain tank. The draining portion 68 collects and stores old water used by the first humidifying portion 65, the second humidifying portion 66, and the like. The draining portion 68 can be detached from the sheet manufacturing apparatus 1 as needed, so as to dispose of the water stored therein.

The strip-shaped sheet P1 transported to the first unit group 101 reaches the first cutting portion 81. The first cutting portion 81 cuts the strip-shaped sheet P1 in a direction orthogonal to the direction of transportation, or in a direction along the x axis, for example. The strip-shaped sheet P1 is cut into single-sheet-shaped sheets P2 by the first cutting portion 81. The single-sheet-shaped sheets P2 are transported from the first cutting portion 81 to the second cutting portion 82.

The second cutting portion 82 cuts each single-sheet-shaped sheet P2 in the direction of transportation, or in a direction along the y axis, for example. Specifically, the second cutting portion 82 cuts out two end portions in the x axis direction of the single-sheet-shaped sheet P2. Thus, the single-sheet-shaped sheet P2 is formed into the sheet P3 in a predetermined shape such as the A4 size and the A3 size.

The slit pieces S being the listing are generated when the second cutting portion 82 cuts the single-sheet-shaped sheet P2 into the sheets P3. The slit pieces S are transported substantially in the −y direction and reach the shredding portion 86 which is the shredder. The shredding portion 86 shreds the slit pieces S into shredded pieces, and supplies the shredded pieces to the confluent portion 17. A mechanism for measuring the shredded slit pieces S and to feed the shredded pieces to the confluent portion 17 may be installed between the shredding portion 86 and the confluent portion 17.

The sheets P3 are transported substantially upward and stacked on the tray 84. The sheets P3 are manufactured by the sheet manufacturing apparatus 1 as described above. For example, the sheets P3 can adopt as an alternative to copy paper and the like.

2. Method of Controlling Sheet Manufacturing Apparatus

Figure 2:
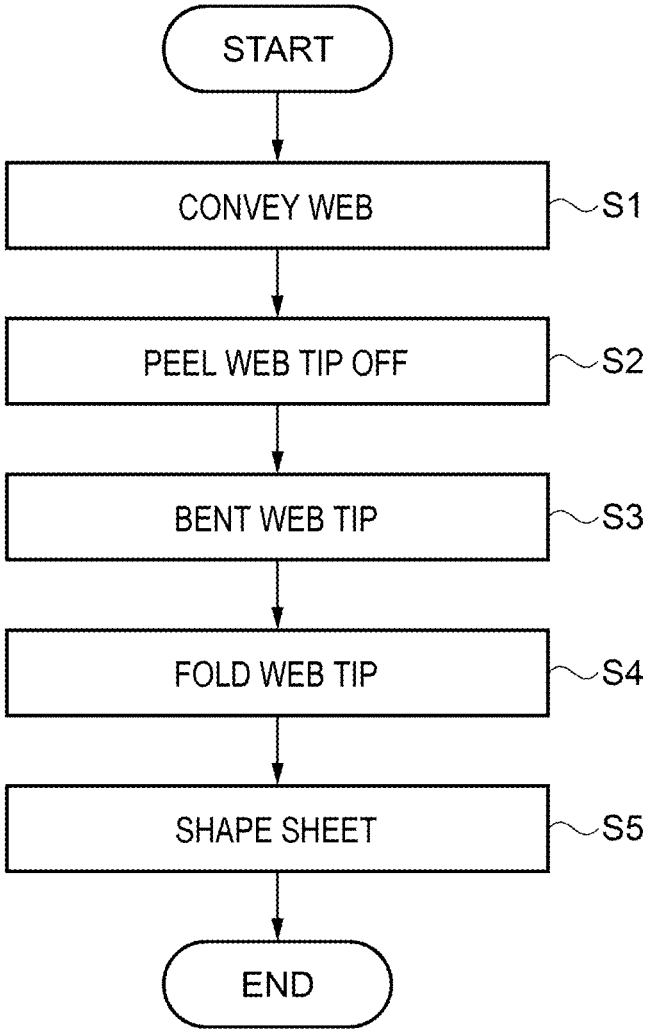
FIG. 2 is a flowchart illustrating a method of controlling the sheet manufacturing apparatus.

As illustrated in FIG. 2, the method of controlling the sheet manufacturing apparatus 1 according to the present embodiment includes a first step S1, a second step S2, a third step S3, a fourth step S4, and a fifth step S5. These steps are executed in the enumerated order in accordance with control by the control unit 5. Now, the respective steps will be described below with reference to FIGS. 3 to 6. The description with reference to FIGS. 3 to 6 will discuss states in side view from the −x direction unless otherwise specified.

Figure 3:
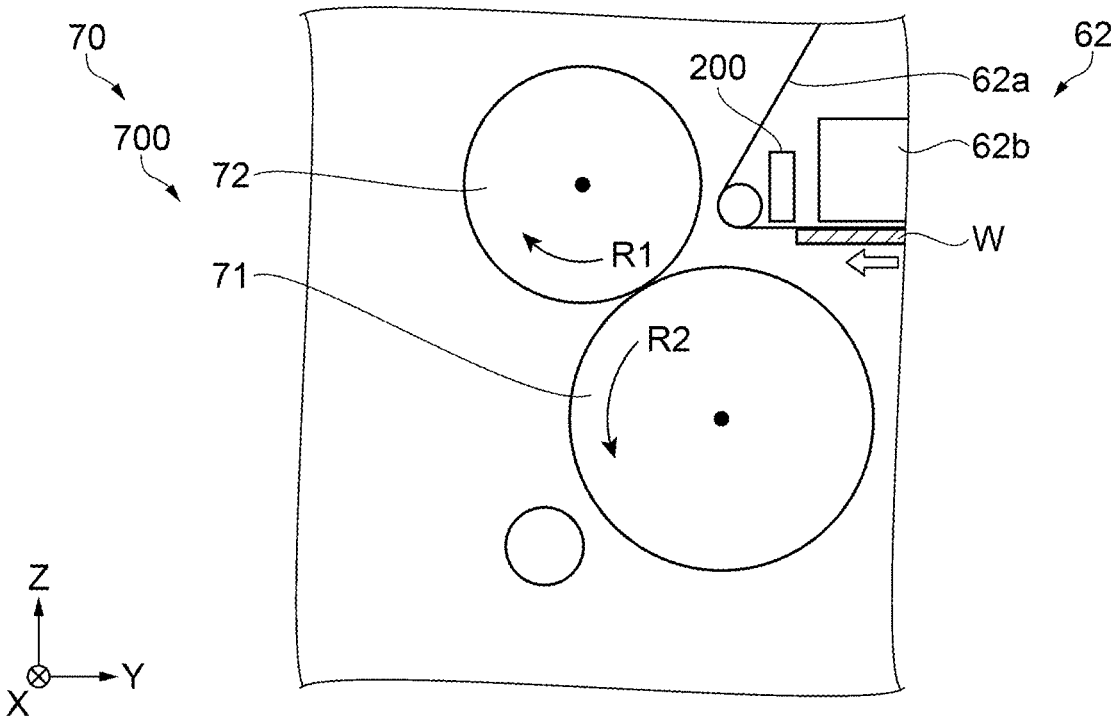
FIG. 3 is a schematic diagram illustrating a web folding method.

As illustrated in FIG. 3, in the first step S1, the second transporting portion 62 transports the web W downstream in the −y direction.

In the original shaping operation to pass the web W between the first roller 71 and the second roller 72, the first roller 71 is rotated in a counterclockwise rotational direction R2 while the second roller 72 is rotated in a clockwise rotational direction R1. In the first step S1, the web W does not reach a point between the first roller 71 and the second roller 72. Accordingly, the rotation of the first roller 71 and the second roller 72 may be stopped or the first roller 71 and the second roller 72 may be rotated in the aforementioned directions as illustrated in FIG. 3, respectively.

Then, the operation proceeds to the second step S2 at a point when the tip end of the web W goes beyond a region opposed to the air injecting portion 200. Here, a method of determination as to whether or not the tip end of the web W reaches the region opposed to the air injecting portion 200 is fulfilled by detecting the position of the tip end of the web W by using an optical sensor. Meanwhile, as another method, it is also possible to adopt a method of carrying out a measurement of time required from a point when the accumulating portion 50 starts driving to a point when the tip end of the web W reaches the position to oppose the air injecting portion 200 in advance, and conducting timing control while presetting the measured time.

Figure 4:
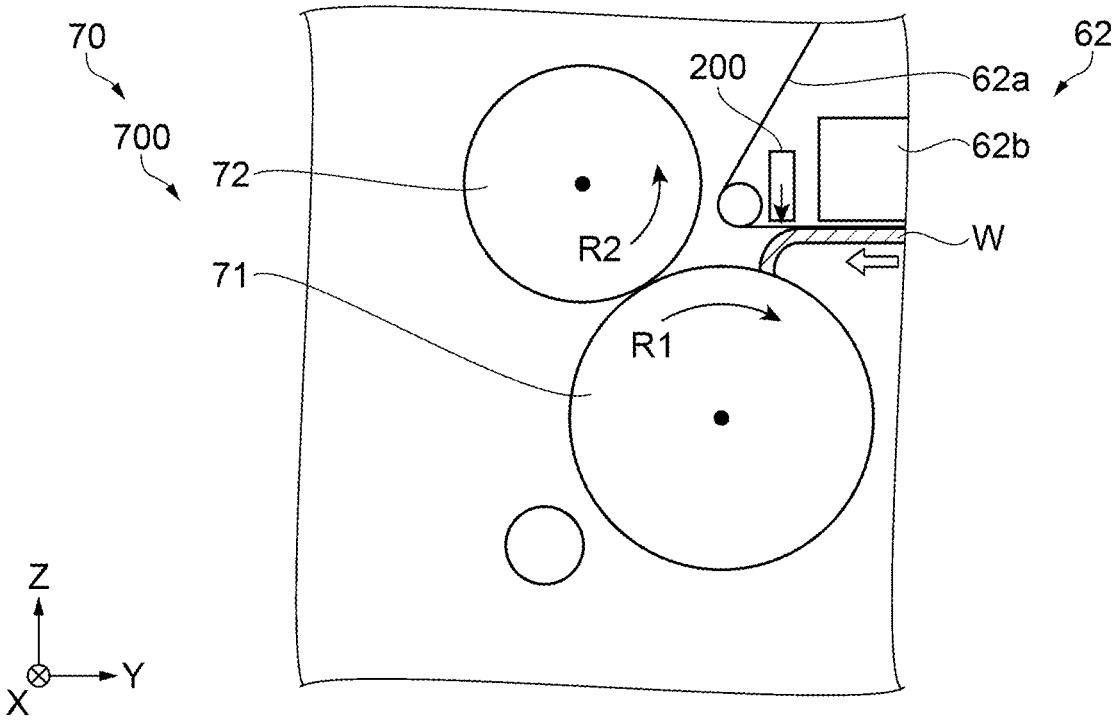
FIG. 4 is another schematic diagram illustrating the web folding method.

As illustrated in FIG. 4, in the second step S2, the tip end of the web W is peeled off the transporting belt 62*a*. Specifically, in the second step S2, the tip end of the web W is peeled off the transporting belt 62*a* by injecting the pressurized air from the air injecting portion 200. The transportation of the web W by the transporting belt 62*a* is continued during this period. Accordingly, the tip end of the web W is suspended downward and comes into contact with the first roller 71.

In this instance, as illustrated in FIG. 4, it is preferable to rotate the first roller 71 in the clockwise rotational direction R1 being a first direction before the operation transitions to the subsequent third step S3. In that case, the second roller 72 is driven by the first roller 71 and is rotated in the counterclockwise rotational direction R2.

In the second step S2, the tip end of the web W is peeled off the transporting belt 62*a* by the pressurized air, and moreover, and the moving direction of the tip end of the web W is changed substantially downward. This facilitates bending of the tip end of the web W in the subsequent third step S3. Then, the operation proceeds to the third step S3.

Figure 5:
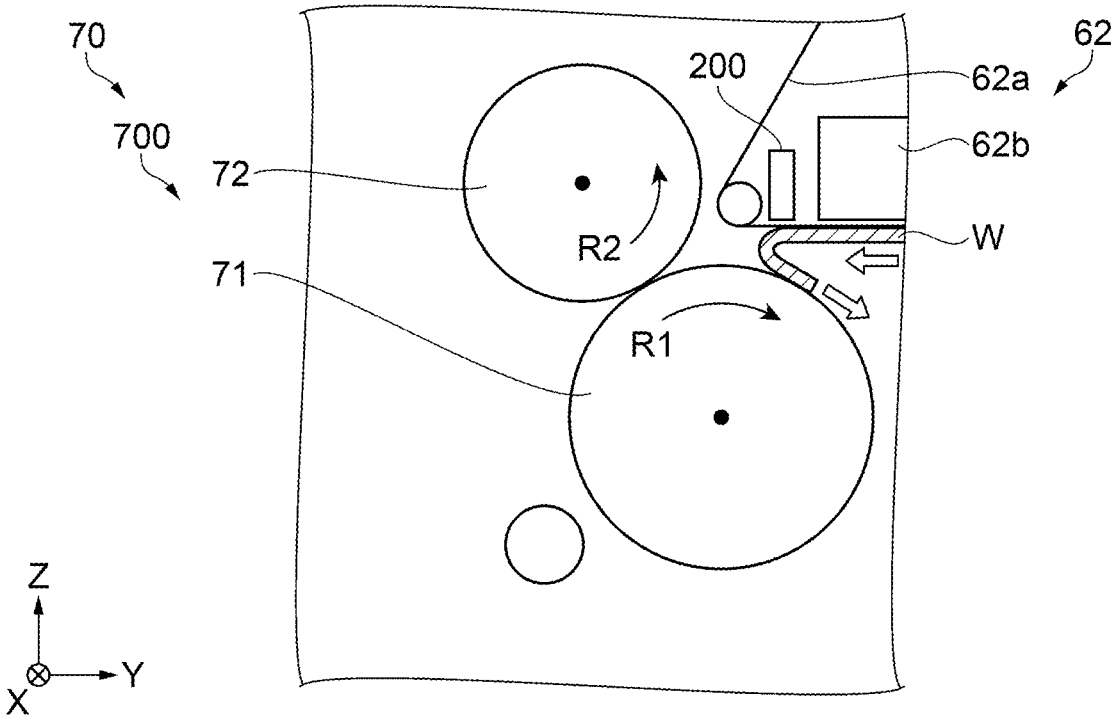
FIG. 5 is another schematic diagram illustrating the web folding method.

As illustrated in FIG. 5, in the third step S3, the first roller 71 is rotated in the rotational direction R1 being the first direction in the state where the tip end of the web W is in contact with the side surface of the first roller 71. The tip end of the web W is pulled by the rotation of the first roller 71 and is bent substantially in the +y direction. In this instance, the second roller 72 is driven by the first roller 71 and is rotated in the counterclockwise rotational direction R2.

In the third step S3, rotation of the first roller 71 in the rotational direction R1 is set to a predetermined period. A distance of the tip end of the web W bent substantially in the +y direction is adjusted by a diameter, a rotational speed, and rotation time of the first roller 71. For example, the time for rotating the first roller 71 in the rotational direction R1 is set to 3 seconds from the start of injection of the pressurized air from the air injecting portion 200. Thus, the tip end of the web W is bent in the +y direction in an amount approximately equal to 60 mm. Then, the operation proceeds to the fourth step S4.

Figure 6:
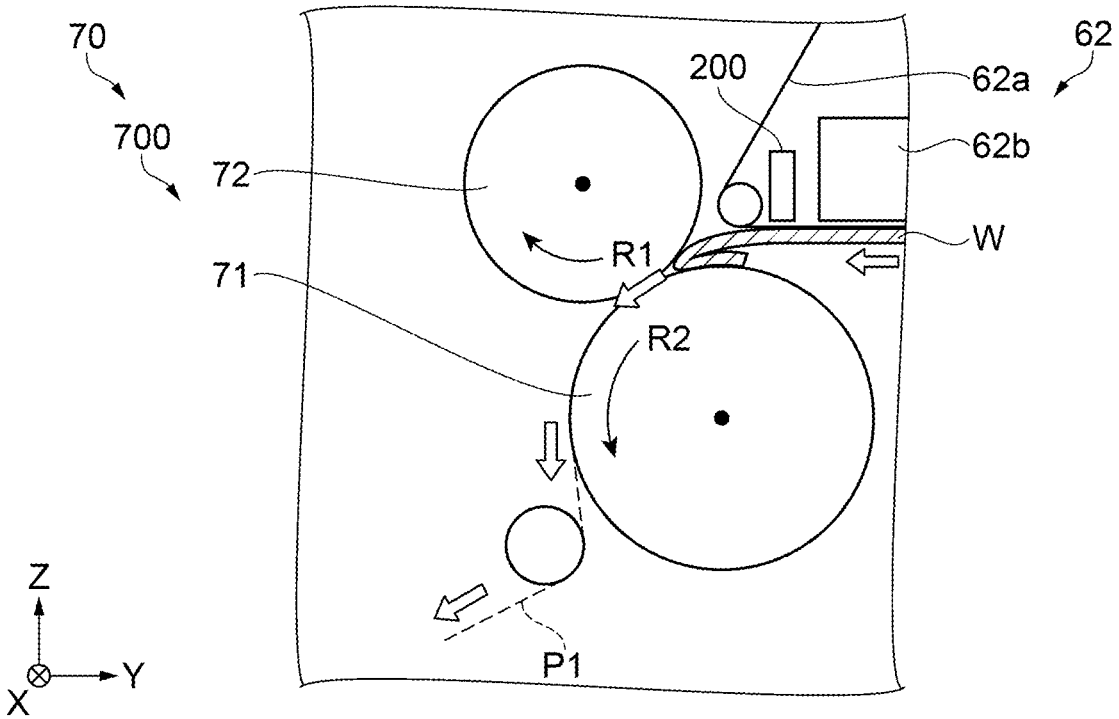
FIG. 6 is another schematic diagram illustrating the web folding method.

As illustrated in FIG. 6, in the fourth step S4, the first roller 71 is rotated in the rotational direction R2 being a second direction opposite to the first direction, and the second roller 72 is driven and rotated in the rotational direction R1. At the same time, the web W is passed between the first roller 71 and the second roller 72 collectively constituting the pair of pressing rollers 700. Thus, the tip end of the web W is pressed and folded. Then, the operation proceeds to the fifth step S5.

In the fifth step S5 subsequent to the fourth step S4, the first roller 71 is continuously rotated in the rotational direction R2 while the second roller 72 is continuously rotated in the rotational direction R1, respectively. Accordingly, the web W is passed between and pressed by the pair of pressing rollers 700, and is heated by the first roller 71 and the second roller 72. Thus, the strip-shaped sheet P1 is continuously shaped. A transportation path for the strip-shaped sheet P1 is indicated with a dashed line in FIG. 6. Thereafter, the strip-shaped sheet P1 is transported toward the above-mentioned first cutting portion 81.

The distance of the fold at the tip end on the downstream side in the direction of transportation of the strip-shaped sheet P1, on in other words, a distance formed by the twofold of the web W only needs to be equal to or above 20 mm, for example. The above-mentioned distance is adjusted by the distance of the tip end of the web W to be bent in the third step S3.

Here, the tip end of the web W is not limited to be formed into the twofold. The tip end of the web W may be formed into a threefold or more by repeatedly carrying out the third step S3 and the fourth step S4 mentioned above. Thus, the thickness and strength at the tip end of the web W are further increased.

Meanwhile, in the above-described second step S2, the tip end of the web W may be bent in a spirally rolled fashion by adjusting the transportation speed of the web W after peeling off the tip end, the rotational speed of the first roller 71, and the like. In this way, the thickness of the web W is increased and the strength at the tip end of the web W is further increased.

The following effects are available from the present embodiment.

Even in the case where the tip end of the web W becomes thin, it is possible to prevent occurrence of a problem. Specifically, since the tip end of the web W is folded, the web W is doubled at the tip end thereof. Accordingly, the thickness and intensity sufficient for reducing the chance of occurrence of a problem as the web W are secured even when the tip end of the web W is thin before being folded. As a consequence, it is possible to provide the method of controlling the sheet manufacturing apparatus 1 that prevents occurrence of a problem even when the tip end of the web W is thin.

What is claimed is:

1. A method of controlling a sheet manufacturing apparatus configured to manufacture a sheet from a material containing a fiber, the sheet manufacturing apparatus being provided with a defibrating portion that defibrates the material containing the fiber and generates a defibrated material, an accumulating portion that forms web by accumulating the defibrated material, a web transporting portion that includes a transporting belt to come into contact with one surface of the web and to transport the web, and a pressing portion that includes a pair of pressing rollers formed from a first roller and a second roller, and forms the sheet by pressing the web, the method of controlling a sheet manufacturing apparatus comprising:

a first step of transporting the web with the transporting belt;

a second step of peeling a tip end of the web off the transporting belt;

a third step of bending the tip end of the web by rotating the first roller in a first direction; and a fourth step of folding the tip end of the web by rotating the first roller in a second direction being opposite to the first direction and passing the web between the pair of pressing rollers wherein the sheet manufacturing apparatus includes an air injecting portion that injects pressurized air, and in the second step, the tip end of the web is peeled off the transporting belt by injecting the pressurized air, and comes into contact with the first roller.

2. The method of controlling a sheet manufacturing apparatus according to claim 1, wherein in the third step, the tip end of the web is bent by rotating the first roller in the first direction for a predetermined period.

3. The method of controlling a sheet manufacturing apparatus according to claim 1, further comprising:

a fifth step subsequent to the fourth step, wherein in the fifth step, the web is pressed while being passed between the pair of pressing rollers, and is heated and shaped by the first roller.

* * * * *